United States Patent [19]

Lehman et al.

[11] Patent Number: 4,774,484

[45] Date of Patent: Sep. 27, 1988

[54] AUXILIARY ELECTRICAL CONTACT FOR ELECTROMAGNETIC CONTACTOR

[75] Inventors: Lewis M. Lehman, Brown Deer; Robert W. Sehmer, Grafton, both of Wis.

[73] Assignee: Square D Company, Palatine, Ill.

[21] Appl. No.: 28,067

[22] Filed: Feb. 5, 1987

Related U.S. Application Data

[63] Continuation of Ser. No. 721,986, Apr. 9, 1985, abandoned.

[51] Int. Cl.[4] ..... H01H 1/48; H01H 1/50

[52] U.S. Cl. ..... 335/197; 335/160; 335/132

[58] Field of Search ..... 335/131, 132, 161, 159, 335/160, 197, 198

[56] References Cited

U.S. PATENT DOCUMENTS

| | | | |
|---|---|---|---|
| 3,339,161 | 8/1967 | Conner et al. | 335/131 |
| 3,382,469 | 5/1968 | Conner | 335/161 |
| 3,388,353 | 6/1968 | Isler | 335/132 |
| 3,449,701 | 6/1969 | Busck | 335/197 |
| 3,639,866 | 2/1972 | Kane | 335/132 |
| 3,949,333 | 4/1976 | Freitag et al. | 335/132 |
| 3,962,658 | 6/1976 | Zunft et al. | 335/133 |
| 4,345,225 | 8/1982 | Lemmer | 335/132 |
| 4,578,659 | 3/1986 | Suter et al. | 335/131 |

*Primary Examiner*—E. A. Goldberg
*Assistant Examiner*—Lincoln Donovan
*Attorney, Agent, or Firm*—A. S. Johnston; R. T. Guttman

[57] ABSTRACT

An apparatus is disclosed for mounting an auxiliary contact external to an electromagnetically operated electrical contactor so that the auxiliary contact may be operated by a carrier of the contactor. The apparatus comprises: a wall of the auxiliary contact; at least one rib projecting from the wall of the auxiliary contact, the at least one rib arranged to be matingly inserted into at least one slot in an external side of the contactor so that the rib attaches the auxiliary contact to the contactor; and, a flexible lever formed from a portion of the wall, and the lever locks into a mating structure when the rib attaches the auxiliary contact to the contactor in order to lock the auxiliary contact in position on the external side of the contactor.

11 Claims, 4 Drawing Sheets

AUXILIARY ELECTRICAL CONTACT FOR ELECTROMAGNETIC CONTACTOR

This application is a continuation of application Ser. No. 721,986, filed on Apr. 9, 1985, now abandoned.

FIELD OF THE INVENTION

This invention relates to auxiliary electrical contacts for electrical contactors, and more particularly, to a mounting structure for conveniently attaching auxiliary contacts to contactors.

BACKGROUND OF THE INVENTION

Electromagnetically operated contactors are employed for closing contacts in electrical circuits drawing heavy loads, and for closing the contacts at a location remote from the position of a person operating the apparatus. It is convenient to have the contactor close or open a number of auxiliary contacts by the motion of the armature and carrier assembly. The assembly controls the heavy load carrying contacts. A typical arrangement previously used for controlling auxiliary contacts by an electromagnetic contactor is shown in U.S. Pat. No. 3,388,353, issued to Isler on June 11, 1968. A problem in the past has been the complexity of the mounting arrangement for the auxiliary contacts. In particular, a disadvantage of the auxiliary contact arrangement shown in U.S. Pat. No. 3,388,353 is that the contacts are held in place by spring loaded retainers and a plate attached by screws. The auxiliary contacts are therefore inconvenient to mount and dismount on the contactor.

A second example of auxiliary contacts attached to a main contactor is shown in U.S. Pat. No. 3,382,469, issued to Connor on May 7, 1968. A disadvantage of the arrangement shown in the Connor reference is that the auxiliary contacts must fit into especially molded compartments of the main contactor, and are held in place by bolts.

A further example of an electromagnetic contactor having an auxiliary contact apparatus attached thereto is shown in U.S. Pat. No. 4,345,225, issued to Lemmer on Aug. 17, 1982. An auxiliary contact containing structure is held in place by four hooks which slide into recessed slots, and the entire structure is captured in place by an additional spring loaded lever which fits into a recess. A disadvantage of this structure is that additional moveable parts are used to capture the auxiliary contacts in place.

SUMMARY OF THE INVENTION

The invention solves the problem of a very simple mounting system for auxiliary contacts so that they may be attached to a contactor and very simply removed from the contactor without the necessity of removing screws or bolts, and without employing spring loaded levers. An apparatus is provided for mounting an auxiliary contact external to an electromagnetically operated electrical contactor so that the auxiliary contact may be operated by a carrier of the contactor. At least one rib projects from a first side of a body of the auxiliary contact, and the at least one rib is arranged to be matingly inserted into at least one slot in an external side of the contactor so that the rib attaches the auxiliary contact to the contactor. Also, a flexible lever is provided which locks into a mating structure when the rib attaches the auxiliary contact to the contactor in order to lock the auxiliary contact in position on the external side of the contactor.

The rib has a first part substantially perpendicular to a side of the body of the auxiliary contact, and the rib has a second part substantially parallel to the side of the body of the auxiliary contact so that when the rib is inserted into the slot, the second part of the rib is substantially parallel to an inside wall of the side of the contactor, and the body of the auxiliary contacts may be moved sideways thereby engaging the second part of the ribs behind the inside wall of the contactor. Also, the flexible lever is attached to the first side of the body of the auxiliary contact and the flexible lever has a projecting knob which may matingly fit into a socket in the external side of the contactor when the body of the auxiliary contact is moved sideways. The knob thereby prevents the second part of the rib from disengaging from the inside wall of the side of the contactor.

Other and further aspects of the present invention will become apparent during the course of the following description and by reference to the accompanying drawings.

BRIEF DESCRIPTION OF THE DRAWINGS

Referring now to the drawings in which like numerals represent like parts in the several views.

DETAILED DESCRIPTION

U.S. patent applications related to the present application and assigned to the assignee of this application include the following: IC-643 for "Hand Protector Shield for Electrical Apparatus", inventors L. M. Lehman, et al, Ser. No. 142,303, now issued as U.S. Pat. No. 4,774,390; IC-645 for "Mounting Apparatus for Arc Quenching Plates for Electric Contacts", inventor L. M. Lehman, Ser. No. 721,984, now issued as U.S. Pat. No. 4,684,772; IC-646 for "Terminal Structure for a Coil", inventors J. Schmiedel, et al, Ser. No. 721,983, now issued as U.S. Pat. No. 4,705,341; IC-652 for "Coil Apparatus for Electromagnetic Contactor", inventors J. Schmiedel, et al, Ser. No. 74,985, now issued as U.S. Pat. No. 4,647,886, all disclosures of which are incorporated herein by reference.

Figure 1:
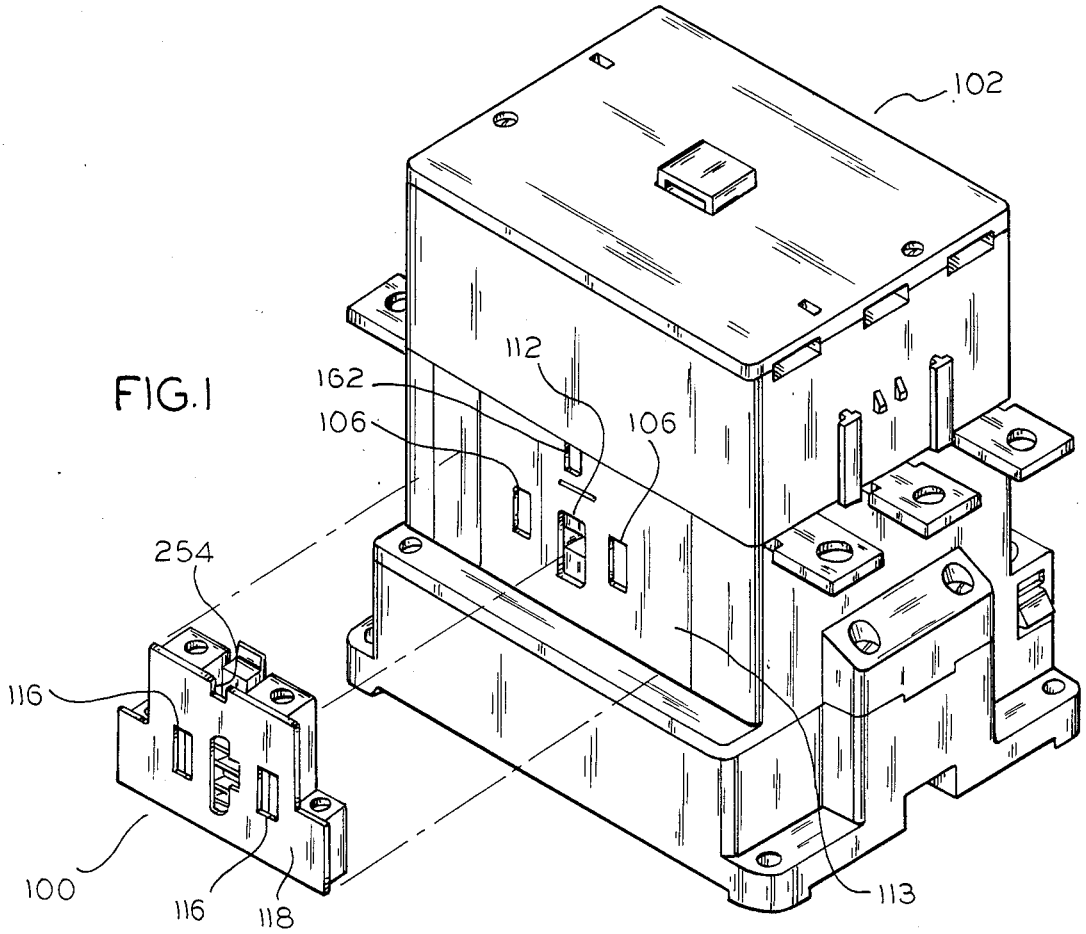
FIG. 1 is a perspective drawing of an electrical contactor showing a auxiliary contact in exploded view.
Figure 2:
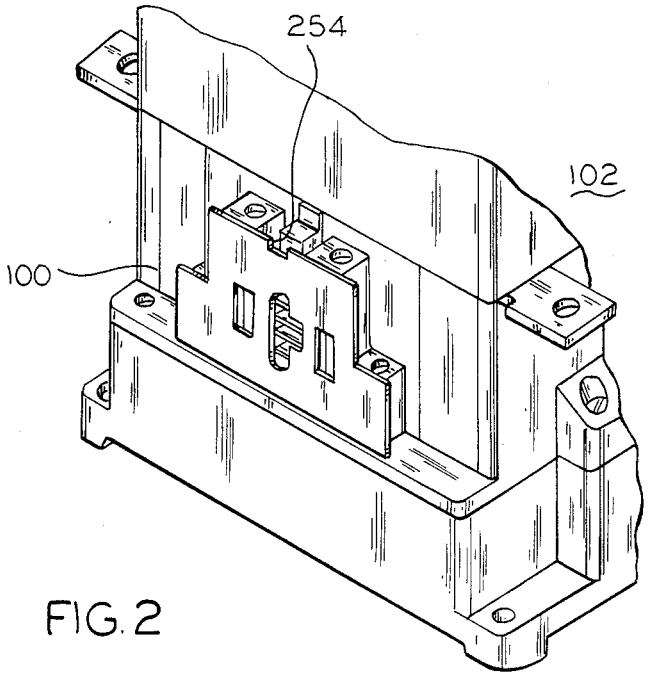
FIG. 2 is a perspective showing an auxiliary contact attached to an electrical contactor.

FIG. 1 shows auxiliary contact 100 in exploded view and in association with electrical contactor 102. In FIG. 2 auxiliary contact 100 is shown attached to the side of contactor 102.

Figure 5:
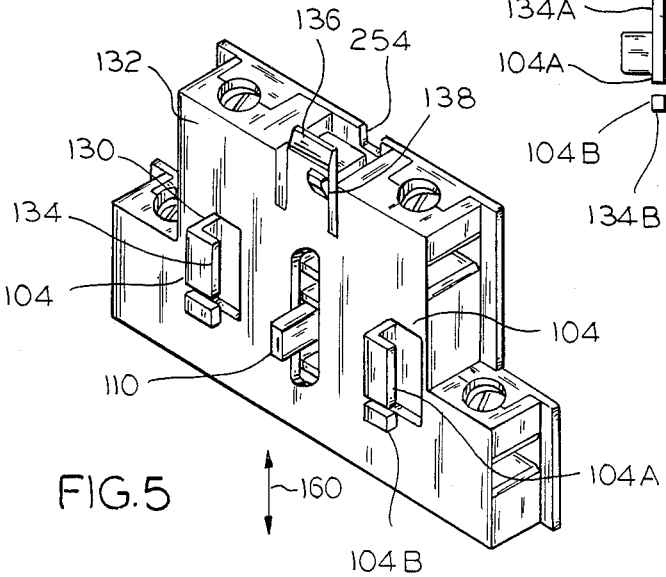
FIG. 5 is a perspective detailed view of an auxiliary contact.

Auxiliary contact 100 attaches to contactor 102 by means of ribs 104, shown in FIG. 5. Ribs 104 insert matingly into slots 106, shown in FIG. 1. Slider operating arm 110, as shown in FIG. 5, passes through hole 112 in side 113 of contactor 102, and engages the carrier (not shown) of the armature (not shown) of contactor 102. As the armature of contactor 102 moves under the influence of the magnet (not shown) of contactor 102, the carrier causes slider operating arm 110 to move in the direction of arrow 160. The movement of the slider occasioned by movement of operating arm 110 causes contacts of auxiliary contact 100 to open or close, as described in greater detail hereinbelow.

Figure 3:
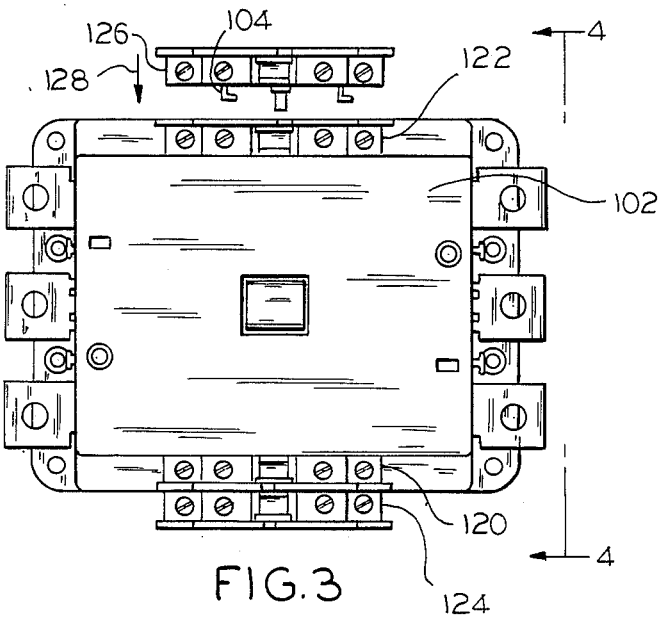
FIG. 3 is a top view showing auxiliary contacts attached to a contactor, with one auxiliary contact shown in exploded view.
Figure 4:
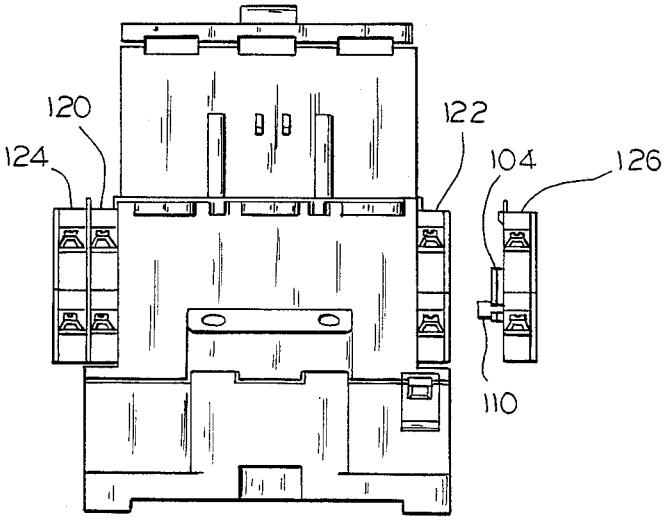
FIG. 4 is a front view of a contactor with two auxiliary units attached to each side, with one of the auxiliary units in exploded position.

Auxiliary contact 100 has slots 116 in its external side 118 for the purpose of "piggybacking" an additional auxiliary contact. FIG. 3 is a top view of an electrical contact 102 showing auxiliary contact 120 and auxiliary contact 122 mounted on opposite sides of contactor 102. Additionally, auxiliary contact 124 is piggybacked onto auxiliary contact 120. Auxiliary contact 126 is shown exploded from auxiliary contact 122, and arrow 128 shows a first direction of motion necessary to assemble auxiliary contact 126 onto auxiliary contact 122 in a piggybacked mode. FIG. 4 is an end view, as shown by the sectional lines in FIG. 3, showing auxiliary contacts 120, 124, 122, and 126.

FIG. 5 is a perspective detailed view of an auxiliary contact, such as may be used for auxiliary contact 120, 122, 124, or 126. Ribs 104 of the auxiliary contact have an L-shaped cross section having a first part 130 mounted substantially perpendicular to side 132, and having a second part 134 mounted substantially parallel to side 132. The auxiliary contact also has flexible lever 136 mounted to side 132 in such a way that flexible lever 136 may flex. Also flexible lever 136 has a projecting knob 138 mounted thereupon.

Figure 6:
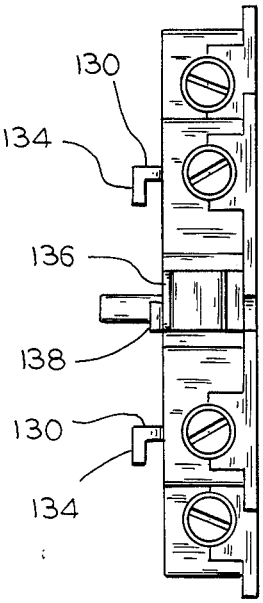
FIG. 6 is a top view of an auxiliary contact.
Figure 7:
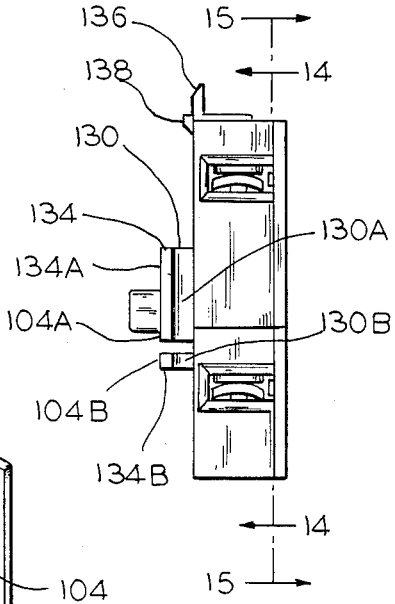
FIG. 7 is a side view of an auxiliary contact.

The auxiliary contact is shown in FIG. 6 in top view, and is shown in FIG. 7 in side view.

Figure 8:
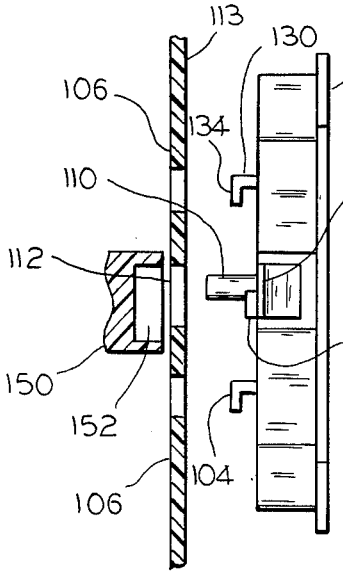
FIGS. 8, 9, and 10 are detailed views showing attachment of an auxiliary contact to the side of an electrical contactor.
Figure 9:
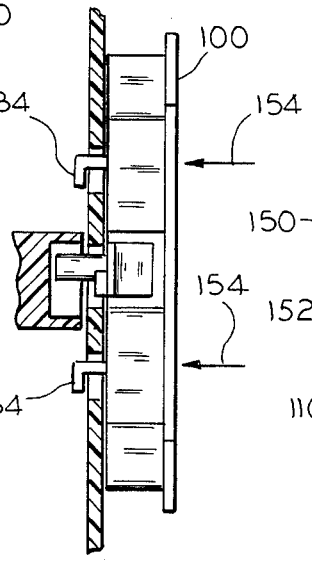
Figure 10:
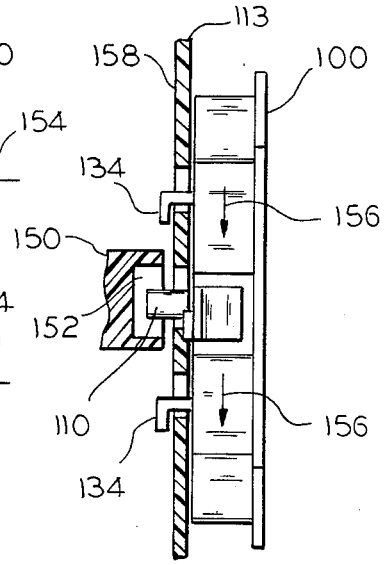

The steps required for attaching auxiliary contact 100 to side 113 of contactor 102 are shown in FIGS. 8, 9, 10, 11, 12 and 13. In FIG. 8 auxiliary contact 100 is shown spaced away from, and substantially parallel to, side 113 of contactor 102. Ribs 104 are aligned with slots 106, and slider operating arm 110 is aligned with hole 112. Carrier 150 of contactor 102 is also shown in FIGS. 8, 9 and 10. Carrier 150 has cavity 152 for receiving slider operating arm 110. Flexible lever 136 is shown along with projecting knob 138, in FIG. 8, and more particularly in FIG. 11, FIG. 12, and FIG. 13.

FIG. 9 shows auxiliary contact 100 moved in the direction of arrows 154 so that it is in contact with side 113, and ribs 104 are inserted into slots 106 so that the second part 134 of the ribs is inside contactor 102. FIG. 10 shows auxiliary contact 100 after it has been moved in the direction shown by arrows 156 so that the second part 134 of ribs 104 is caught behind the interior wall 158 of side 113 of contactor 102. The second part 134 of ribs 104 being caught behind the inside wall 158 of side 113 of contactor 102 locks the auxiliary contact 100 into position on contactor 102. Also shown in FIG. 10 is slider operating arm 110 captured within cavity 152 of carrier 150. Carrier 150 moves in a direction perpendicular to the plane of the page of FIGS. 8, 9 and 10 during electromagnetic operation of contactor 102. Consequently, carrier 150 causes slider operating arm 110 to move in the directions shown by arrow 160 in FIG. 5.

Figure 11:
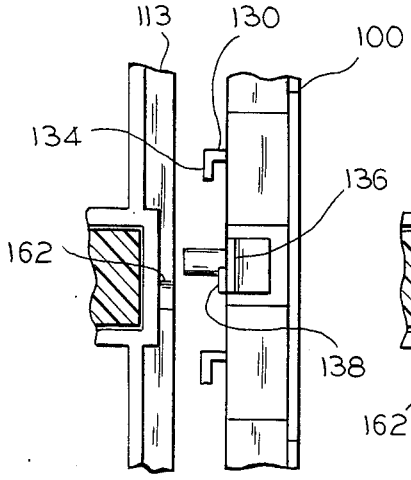
FIGS. 11, 12, and 13 are detailed views showing the attachment of an auxiliary contact to the side of a contactor.
Figure 12:
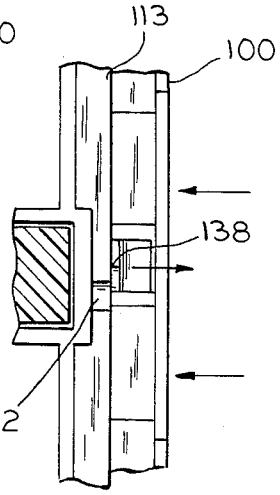
Figure 13:
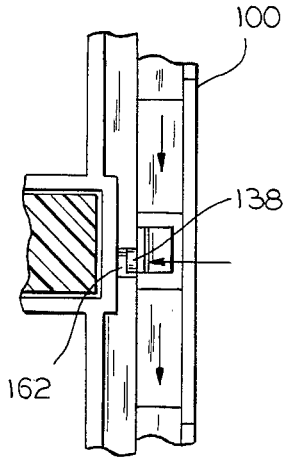

FIG. 11 is a detailed view of auxiliary contact 100 which corresponds to the position shown in FIG. 8, except the details of flexible arm 136, projecting knob 138, and socket 162 formed in side 113 of contactor 102 are shown in detail. FIG. 12 shows auxiliary contact 100 in contact with side 113 in a position corresponding with that position shown in FIG. 9. FIG. 13 shows auxiliary contact 100 in position corresponding with FIG. 10, and particularly shows projecting knob 138 fitting into socket 162. Auxiliary contact 100 is held in place on side 113 of contactor 102 by the second part 134 of ribs 104 being captured behind interior wall 158 of side 113, in conjunction with projecting knob 138 of flexible lever 136 being captured within socket 162 of side 113. Second part 134 of ribs 104 hold auxiliary contact 100 in place against side 113 of contactor 102. And, projecting knob 138 being caught within socket 162 prevents auxiliary contact 100 from shifting in position and thereby prevents second part 134 of ribs 104 from moving into the position shown in FIG. 9 where it would release auxiliary contact 100 from side 113.

Figure 14:
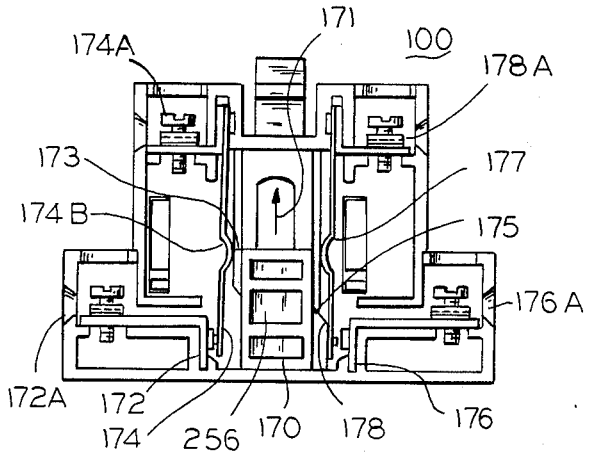
FIG. 14 is a sectional view of an auxiliary contact, sectional lines being shown in FIG. 7.
Figure 15:
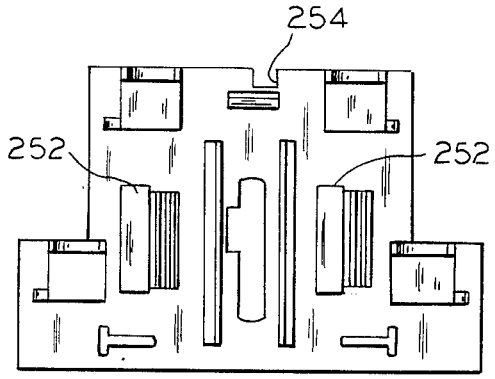
FIG. 15 is a sectional view of an auxiliary contact, sectional lines being shown in FIG. 7.

When an auxiliary contact is piggybacked onto a first auxiliary contact as shown in FIG. 3 and FIG. 4, then the piggybacked auxiliary contact must be locked in place on the first auxiliary contact. Ribs 104 as shown in FIGS. 3 and 4 insert into slots 116 as shown in FIG. 1, and as shown in greater detail as slots 252 in FIG. 15. Also, projecting knob 138 snaps into cut out 254 in order to lock the piggybacked auxiliary contact, 124 or 126, into position. Also, slider operating arm 110 in auxiliary contact 126 or 124 matingly fits into a cavity in the slider of contact 122 or 120. In FIG. 14 cavity 256 in slider 170 receives slider operating arm 110 of the piggybacked contact. Thus, in the piggybacked configuration carrier 150, in its motion perpendicular to the plane of FIG. 8, FIG. 9, and FIG. 10 causes the slider of all four auxiliary contacts 120, 122, 124, and 126 to move in unison in the direction of arrow 160, along with the main contacts (not shown) of contactor 102.

Ribs 104, as shown in FIG. 4, FIG. 5, and FIG. 7, are each cut into two parts, 104A and 104B. The ribs are cut into two parts, 104A, 104B, in order to increase flexibility of part 130, which is cut into parts 130A and 130B, and increase the flexibility of part 134 which is cut into parts 134A and 134B. An alternative embodiment of the invention wherein the ribs are not cut and parts 104A and 104B are a single solid rib has been employed. However, it has been found that the increased flexibility of the ribs obtained by cutting the ribs into sections is advantageous in improving the ease with which the auxiliary contact may be mounted on and dismounted from contactor 102.

The internal construction of auxiliary contact 100 is shown in FIG. 14 through FIG. 19. Sectional lines in FIG. 7 show the view shown in FIG. 14, and also show the view shown in FIG. 15. FIG. 14 shows slider 170 in a lower position. Projection 173 is shown pressing moveable contact 174 into physical contact with stationary contact 172 by projection 173 bearing against bend 174B. In the slider position shown in FIG. 14, there is electrical continuity between terminal 172A and terminal 174A. When slider 170 is moved in the direction shown by arrow 171 then projection 175 moves into contact with bend 177, thereby causing moveable contact 178 to come into physical contact with stationary contact 176, and in this configuration electrical continuity is established between terminal 176A and terminal 178A. Also, when projection 175 is in contact with bend 177 of moveable contact 178, then projection 173 does not bear against bend 174B and therefore moveable contact 174 is displaced apart from stationary contact 172, and electrical continuity is broken between terminal 172A and terminal 174A. Further, in the configuration shown in FIG. 14, electrical continuity is established between terminals 172A and 174A, and there is no electrical continuity between terminal 176A and 178A. Moving slider 170 in the direction shown by arrow 171 causes electrical continuity between terminal 172A and 174A to be broken and causes electrical continuity to be established between terminal 176A and terminal 178A.

Figure 16:
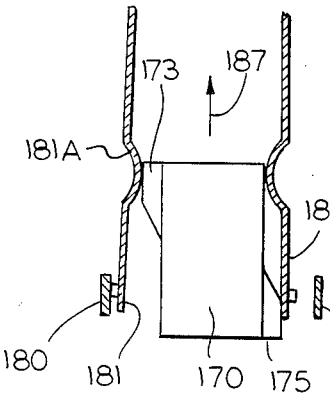
FIGS. 16, 17, 18 and 19 show various contact and slider arrangements.

FIG. 16 shows a slider with projections 173 and 175 arranged as shown in FIG. 14. Contacts 180 and 181 then establish electrical continuity in the position shown in FIG. 16, and contacts 185 and 186 have no electrical continuity in the configuration shown in FIG. 16. When slider 170 is moved in the direction shown by arrow 187 then projection 175 causes electrical continuity to be established between contacts 185 and 186, and projection 173 moves away from bend 181A and causes electrical continuity between contacts 180 and 181 to be broken.

Figure 17:
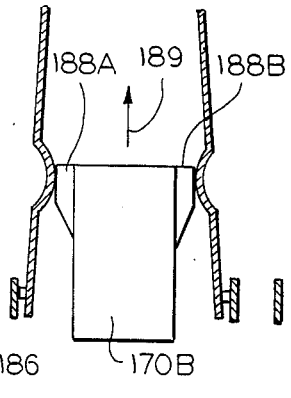
Figure 18:
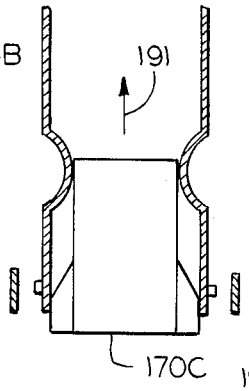

FIG. 17 shows slider 170B having projections 188A and 188B. In the position shown in FIG. 17 both sets of contacts have established electrical continuity. When slider 170B is moved in the direction shown by arrow 189 projections 188A and 188B move away from the bends in the moveable contacts, causing both contacts to break electrical continuity. FIG. 17 thus shows a slider controlling two closed contacts which are opened when the slider is moved in the direction shown by arrow 189. Correspondingly, FIG. 18 shows a slider having projections such that the electrical continuity for both sets of contacts is broken in the position shown in FIG. 18, and for which electrical continuity is established when the slider is moved in the direction shown by arrow 191.

Figure 19:
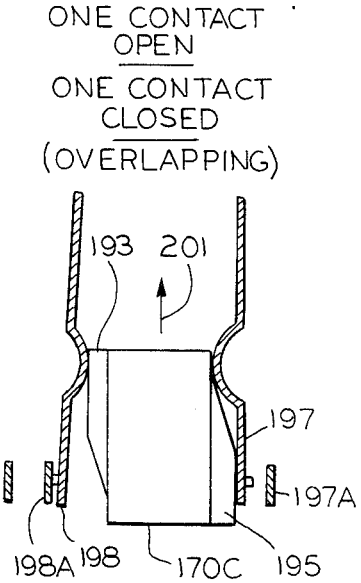

In FIG. 19, slider 170C has projections 193 and 195. The length of projections 193 and 195 is such that electrical continuity is established in contacts 197 and 197A before electrical continuity is broken in contacts 198 and 198A. FIG. 19 therefore shows a configuration of the slider in which one contact is open, one is closed, and there is overlap closure of the contacts upon movement of the slider in the direction shown by arrow 201.

Figure 20:
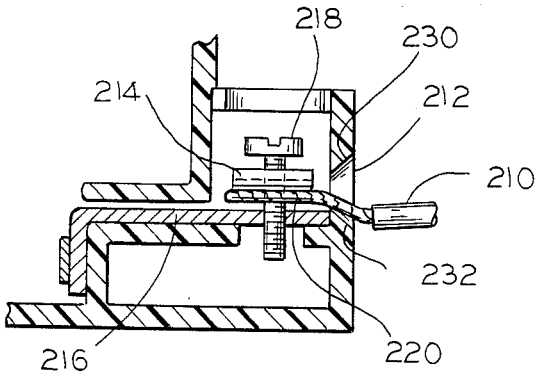
FIG. 20 is a detailed view showing connection of a wire through a tapered hole to a terminal in an auxiliary contact.

FIG. 20 is a detailed view of a wiring terminal of auxiliary contact 100. A wire 210 is inserted in tapered hole 212. Wire 210 extends between clamp 214 and terminal member 216. Screw 218 may be tightened to force clamp 214 against the bare part 220 of wire 210 and terminal member 216, thereby establishing electrical continuity between wire 210 and terminal member 216. Also, force exerted by clamp 214 and terminal member 216 captures wire 210 to the terminal and prevents its being pulled away from the terminal. Tapered sides 230 and 232 of tapered hole 212 guide the bare part 220 of wire 210 as it is inserted into the terminal as shown in FIG. 20. The tapering of holes 212 provide a convenient guiding action for an electrician as he attaches wire 210 to the terminal.

Parts for contactors may be made out of a variety of plastic materials. For example, for a contactor rated to control a 132 kilowatt motor at 380 volts, three phase alternating current, the following materials have been found to be suitable for the various parts: the upper housing, the middle housing, and the contact carrier may be made from glass reinforced thermoset polyester; and the lower housing may be made of glass reinforced polycarbonate. For contactors designed to control up to 75 kilowatt motors at 380 volts, three phase alternating current, the same materials as used for the 132 kilowatt device have been found to be suitable. For contactors designed to control 37 kilowatt motors of 380 volts three phase alternating current it has been found suitable to use the following materials: for the middle and upper housing, glass reinforced thermoset polyester; for the contact carrier, glass reinforced polyphenylene sulfide; and for the lower housing glass reinforced polycarbonate. For a contactor designed to control a 22 kilowatt motor it has been found suitable to use the following materials, for both an upper and a lower housing, glass reinforced polycarbonate, and contactors of this size may have no middle housing, and further, the carrier may be made of glass reinforced thermoset polyester. In all cases, it has been found suitable to make the coil cup and bobbins from glass reinforced PET, polyethelene teraphthalate thermoplastic polyester. Also, for all sizes of contactors glass filled polycarbonate has been found to be suitable for making a retaining plate for arc quenching plates. Materials referred to herein as rubber, for example, rubber supports or rubber mats, may suitably be made from ethylene acrylic. A suitable material for an indicator button has been found to be polycarbonate. Spring seats have been found useful on larger devices, and a suitable material for a spring seat has been found to be glass reinforced PBT, polybutylene teraphthalate thermoplastic polyester. A finger protector has been found useful on these devices, and a finger protector may be made of polypropylene. For making a clip, used to attach a smaller contactor to a DIN rail, type 6/6 nylon has been found to be suitable. An auxiliary contact may have a case and cover made of polycarbonate and a cam made of teflon filled acetal.

It is to be understood that the above described embodiments are simply illustrative of the principals of the invention. Various other modifications and changes may be made by those skilled in the art which will embody the principals of the invention and fall within the spirit and scope thereof.

What is claimed is:

1. An apparatus for mounting an auxiliary contact external to an electromagnetically operated electrical contactor so that said auxiliary contact may be operated by said contactor, comprising:

a side of said contactor, said side having an opening therein;

a carrier in said contactor, said carrier having linear motion in a predetermined direction when said contactor is energized, said opening having a predetermined width perpendicular to said direction of linear motion of said carrier, and a cavity in said carrier;

a wall of said auxiliary contact;

a least one rib projecting from said wall of said auxiliary contact, said at least one rib having a first portion substantially perpendicular to said wall, said at least one rib having a second portion substantially parallel to said wall, said second portion of said rib arranged to be inserted into at least one slot in said side of said contactor; said auxiliary contact having at least one contact set, a slider in said auxiliary contact said slider moves substantially parallel to said direction of linear motion of said carrier, causing the said at least one contact set to move substantially perpendicular to the movement of the slider, said slider having a projection for coupling into said cavity in said carrier, said projection fitting through said opening in said side of said contactor and engaging said cavity, said predetermined width of said opening chosen so that said second portion of said at least one rib and said projection may be inserted into said side of said contactor and subsequently moved until said second portion of said at least one rib extends along an inner surface of said side of said contactor thereby attaching said auxiliary contact to said contactor, and said cavity providing driving force to said projection to move said slider substantially parallel to said carrier when said carrier moves;

a flexible lever formed from a portion of said wall, said lever substantially parallel to said wall, and said lever locking into a mating structure when said second portion of said rib engages said inner surface of said side of said contactor in order to lock said auxiliary contact in position on said external side of said contactor, said lever having a tab for releasing said lever from said mating structure to unlock said auxiliary contact from said side of said contactor, said tab accessible from an outside of said contactor, and said tab capable of being operated by a screwdriver.

2. The apparatus as in claim 1 further comprising:

said flexible lever being attached to said first side of said body of said auxiliary contact and said flexible lever having a projecting knob which may matingly fit into a socket in said external side of said contactor when said body of said auxiliary contact is moved sideways, said knob thereby preventing said body of said auxiliary contact from moving sideways and thereby preventing said second part of said rib from disengaging from said inside wall of said side of said contactor.

3. The apparatus as in claim 1 wherein said at least one rib comprises at least two ribs.

4. The apparatus as in claim 1 wherein said at least one rib comprises two ribs.

5. The apparatus as in claim 1 further comprising:

a second wall of said auxiliary contact substantially parallel to said wall of said auxiliary contact, said second wall having two slots formed therein and having a hole formed therein so that a second auxiliary contact may be mounted upon said second wall of said auxiliary contact, said at least one rib engaging said slot in said second wall, and said flexible lever locking into said hole in said second wall.

6. The apparatus as in claim 1 wherein said wall of said auxiliary contact, said at least one rib projecting from said wall, and said flexible lever formed from a portion of said wall, comprises: a single molded plastic part.

7. An improved auxiliary contact for an electromagnetically operated electrical contactor, comprising:

a side of said contactor, said side having an opening therein, said auxiliary contact having at least one contact set, a carrier having linear motion in a predetermined direction when said contactor is energized, a wall of said auxiliary contact, said wall being substantially planar, at least one rib projecting from said wall of said auxiliary contact, said at least one rib having a first portion substantially perpendicular to said wall, said at least one rib having a second portion substantially parallel to said wall, a slider in said auxiliary contact said slider moves substantially parallel to said direction of linear motion of said carrier, causing the contacts of said at least one contact set to move substantially perpendicular to the movement of the slider, a flexible lever formed from a portion of said wall to lock said auxiliary contact in position on said external side of said contactor, a projection from said slider for coupling into a cavity in said carrier, said cavity having a long dimension substantially perpendicular to said direction of linear motion of said carrier, and said cavity having a short dimension substantially parallel to said direction of linear motion of said carrier, said opening in said side of said contactor having a predetermined width parallel to said long dimension of said cavity, said projection fitting through said opening in said side of said contactor and engaging said cavity, said predetermined width chosen so that said second portion of said at least one rib and said projection may be inserted into said side of said contactor and subsequently moved in a direction substantially parallel to said long dimension of said cavity until said second portion of said at least one rib extends along an inner surface of said side of said contactor thereby attaching said auxiliary contact to said contactor, and said short dimension of said cavity providing driving force to said projection to move said slider when said carrier moves; and, a knob on said flexible lever for matingly fitting into a hole in said side of said contactor, said lever substantially co-planar with said wall of said auxiliary contact, whereby said auxiliary contact attaches to a substantially planar portion of said side of said contactor, and said lever and said knob lock said auxiliary contact in place on said side of said contactor.

8. An improved auxiliary contact for a contactor of the type having, a carrier having motion substantially parallel to a side of said contactor;

a first auxiliary contact having a first slider engaged by said carrier, said first slider capable of operating contacts when moved by said carrier in said direction substantially parallel to said side of said contactor, wherein the improvement comprises:

a first projection from said first slider for coupling with said carrier, and said motion of said carrier substantially parallel to a side of said contactor is transmitted to said first slider by said first projection, and said first slider having a hole formed therein; and, means for mounting a second auxiliary contact to said first auxiliary contact, and a projection from a second slider in said second auxiliary contact engaging said hole in said first slider whereby said motion substantially parallel to a side of said contactor is transmitted to said second slider by said second projection.

9. The apparatus as in claim 8 wherein said second auxiliary contact is substantially identical to said first auxiliary contact.

10. The apparatus as in claim 1 further comprising:

at least one stationary electric contact in said auxiliary contact;

at least one moveable electric contact in said auxiliary contact; and, at least one operating surface on said slider, said at least one operating surface capable of moving said moveable electric contact in a direction substantially perpendicular to a direction of motion of said slider, and a force applied by said moveable contact to said slider is in a direction substantially perpendicular to said direction of motion of said slider, thereby said force applied by said moveable contact to said slider does not urge said carrier to move.

11. An improved auxiliary contact for a contactor, comprising:

a carrier having motion substantially parallel to a side of said contactor;

a slider in said auxiliary contact;

a projection of said slider for coupling into a cavity in said carrier, and said motion of said carrier substantially parallel to a side of said contactor is transmitted to said slider by said projection;

at least one stationary electric contact in said auxiliary contact;

at least one moveable electric contact in said auxiliary contact; and, at least one operating surface on said slider, said at least one operating surface capable of moving said moveable electric contact in a direction substantially perpendicular to a direction of motion of said slider, and a force applied by said moveable contact to said slider is in a direction substantially perpendicular to said direction of motion of said slider, thereby said force applied by said moveable contact to said slider does not urge said carrier to move.

* * * * *